US005081568A

United States Patent [19]

Dong et al.

[11] Patent Number: 5,081,568

[45] Date of Patent: Jan. 14, 1992

[54] TRAFFIC POLICE BATON WITH MEANS TO INDICATE THE DIRECTION IN THE NIGHT

[76] Inventors: Lu J. Dong; Chen C. Wang, both of No. 36, Lane 360, Chung Cheng Road, Pan Chiao, Taipei Hsien, Taiwan

[21] Appl. No.: 705,977

[22] Filed: May 28, 1991

[51] Int. Cl.[5] ..... F21L 7/00

[52] U.S. Cl. ..... 362/184; 362/102; 362/183; 362/800; 340/321

[58] Field of Search ..... 362/109, 102, 183, 184, 362/186, 205, 234, 228, 800; 340/321

[56] References Cited

U.S. PATENT DOCUMENTS 2,549,103 4/1951 Krauss ..... 362/102 X 2,915,744 12/1959 Lewis ..... 340/321

3,114,143 12/1963 Robinson ..... 340/321

*Primary Examiner*—Stephen F. Husar

*Attorney, Agent, or Firm*—Lowe, Price, LeBlanc & Becker

[57] ABSTRACT

A traffic police baton, comprising a light transmitting cylinder which has a corrugated inner wall covered with a layer of light dispersive film, a circuit board assembly fastened in said light transmitting cylinder which has a plurality of high light intensity of light emitting diodes connected together and longitudinally aligned, and a control circuit to control saidd high light intensity of light emitting diodes to flash in sequence according to predetermined setting.

2 Claims, 5 Drawing Sheets

TRAFFIC POLICE BATON WITH MEANS TO INDICATE THE DIRECTION IN THE NIGHT

BACKGROUND OF THE INVENTION

The present invention relates to traffic police baton and relates more particularly to such a traffic police baton which has means to automatically indicate the direction for the traffic to follow.

The know structure of traffic police baton which is to be used at night to conduct traffic is generally comprised of a light transmitting cylinder secured to a handle, a lamp set set in said light transmitting cylinder and controlled by a power switch to give light, and a battery power supply fastened in said handle to provide said lamp set with working voltage. One disadvantage of this known structure of traffic police baton is that the lamp set is controlled to give light but not to indicate the traffic the direction to follow. Another disadvantage of this known structure of traffic police baton is that the battery power unit is not rechargeable and power fail problem may happen when it is in use.

SUMMARY OF THE INVENTION

The present invention has been accomplished to eliminate the aforesaid problems. It is therefore an object of the present invention to provide a traffic police baton which has means to automatically indicate the direction at night or under dark condition. It is another object of the present invention to provide a traffic police baton which has means to connect outside AC/DC power supply to charge the battery power supply set therein.

According to the present invention, there is provided a traffic police baton which is generally comprised of a light transmitting cylinder, which has a corrugated inner wall covered with a layer of light dispersive film, a circuit board assembly fastened in said light transmitting cylinder, which has a plurality of high light intensity of light emitting diodes connected together and longitudinally aligned, and a control circuit to control said high light intensity of light emitting diodes to flash in sequence according to predetermined setting. A power supply unit is provided to provide the control circuit with necessary working voltage, which comprises a cartridge having a plurality of batteries set therein and connected in series, and a charger to connect external AC/DC power supply to charge said rechargeable batteries.

DETAILED DESCRIPTION OF THE PREFERRED EMBODIMENT

Figure 1:
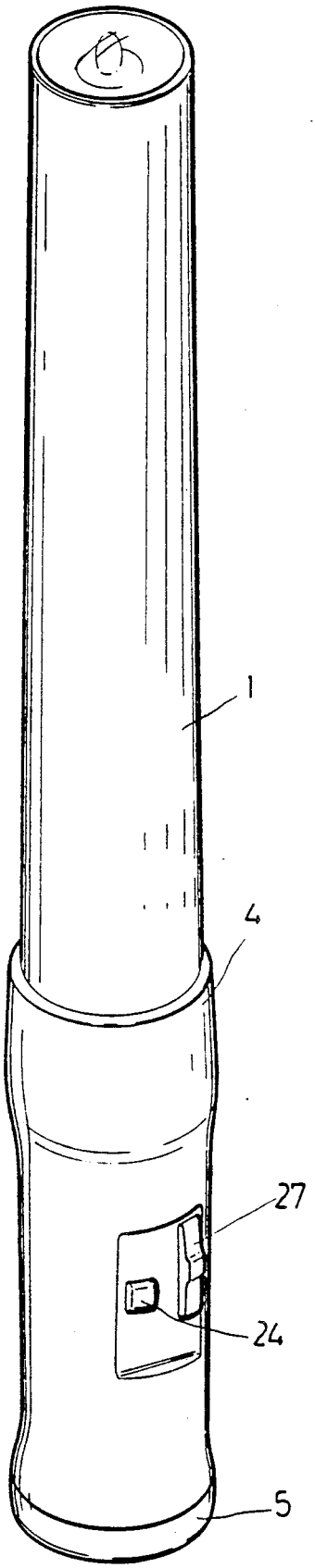
FIG. 1 is a perspective view of the preferred embodiment of the traffic police baton of the present invention.
Figure 2:
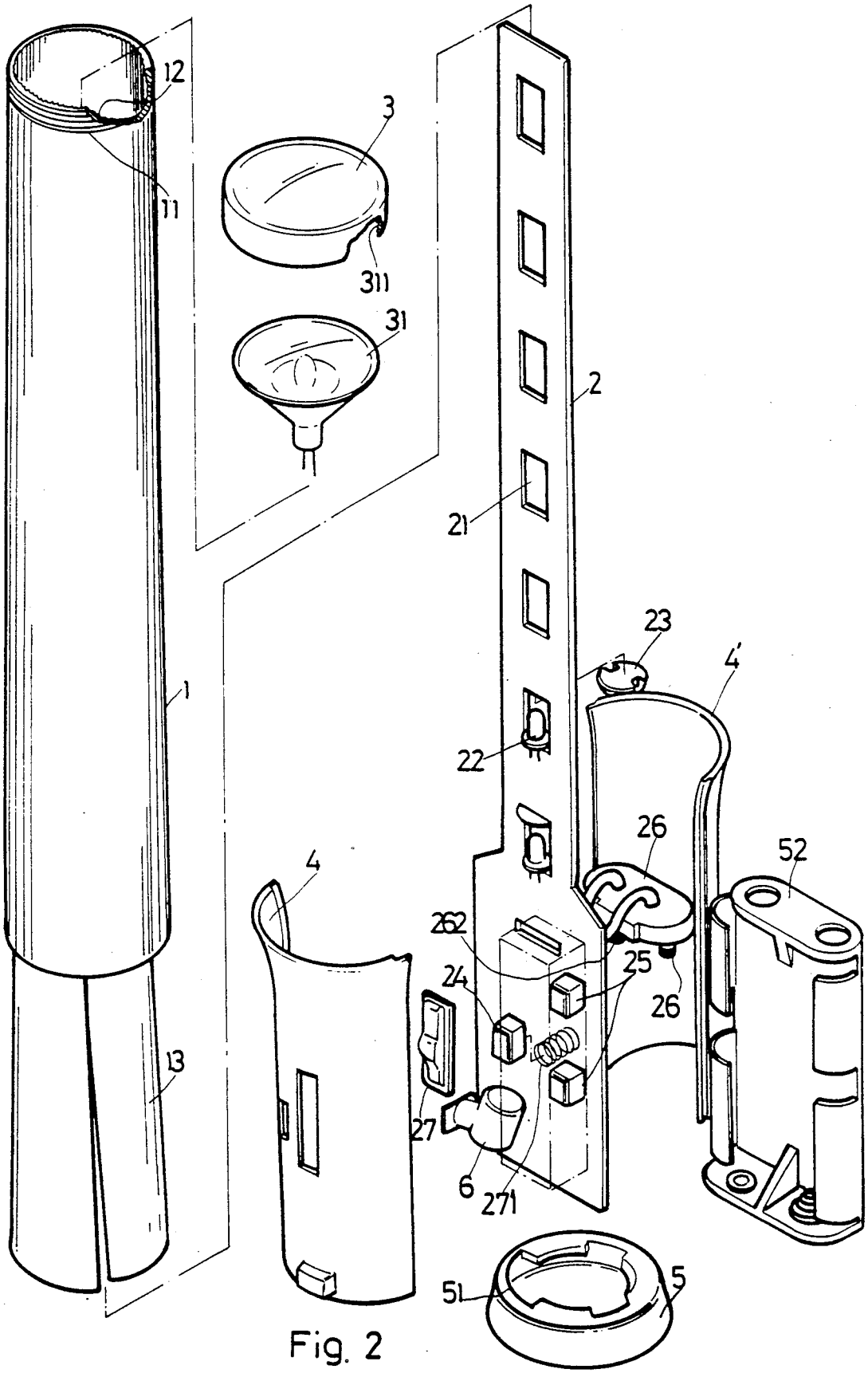
FIG. 2 is dismantled perspective view thereof.
Figure 3:
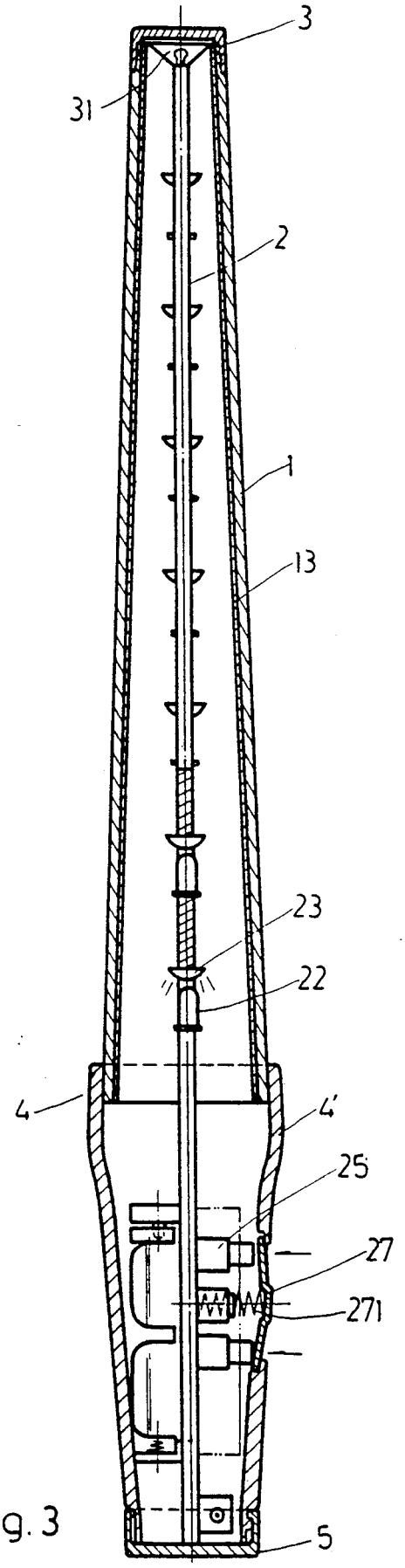
FIG. 3 is a sectional view thereof taken in longitudinal direction.
Figure 4:
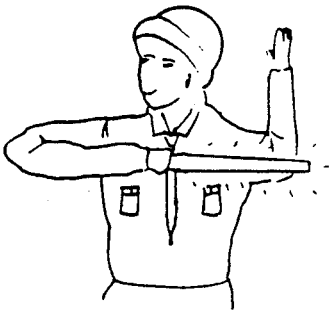
FIGS. 4 and 5 illustrate the use of the present invention in conducting the traffic.
Figure 5:
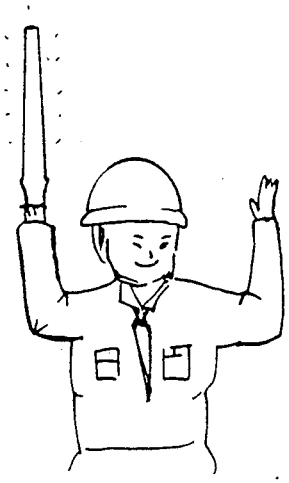
Figure 6:
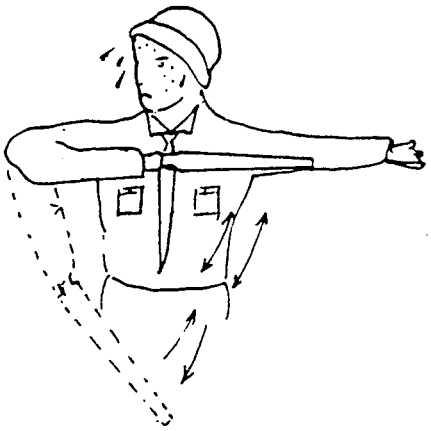
FIGS. 6 and 7 illustrate the use of a conventional traffic police baton in conducting the traffic.
Figure 7:
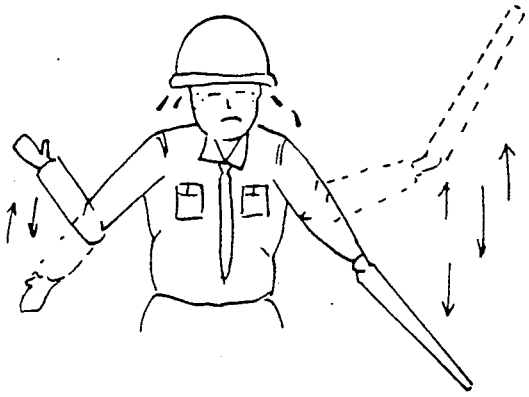

Referring to FIGS. 1, 2 and 3, a traffic police baton in accordance with the present invention is generally comprised of a light transmitting cylinder 1, a circuit board assembly 2, a top cap 3, a handle 4 and a bottom cap 5.

The light transmitting cylinder 1 has two openings at two opposite ends, an outer thread 11 at one end (the top end), a corrugated surface portion 12 over the inner wall thereof. a light dispersing film 13 covering over said corrugated surface portion 12 to intensify the light that passes therethrough. The circuit board assembly 2 is made in an elongated shape covered with a layer of copper film at one side, having one end inserted inside the handle 4, an opposite end extending to the top end of the light transmitting cylinder 1, a plurality of holes 21 longitudinally aligned, a plurality of high light intensity of light emitting diodes (LED) 22 respectively fastened in said holes 21 at one end and connected to said layer of copper film and longitudinally disposed in same direction, a plurality of reflectors 23 respectively fastened in said holes 21 at an opposite end to reflect the light to the light dispersing film 13. The LEDs 22 are controlled to alternatively flash according to predetermined setting. In the present embodiment, the LEDs 22 can be controlled to alternatively flash in one direction from either end toward the opposite end or, divided into two opposed groups and controlled to alternatively flash from two opposite ends toward the center, so as to conduct the traffic or people to go in one direction or to stop. In addition to resistors and various necessary electronic component parts, the circuit board assembly 2 further comprises a power switch 24 for power control, a selector switch 25 for controlling the flash mode of the LEDs, a socket 26 having two spring terminals 261 and 262 respectively connected to the two terminals of the battery unit 52 which is comprised of a cartridge with batteries connected in series, and set inside the handle 4. The selector switch 25 is comprised of a key 27 supported by a spring 271. By pressing on the key 27 at either end, the flash mode of the LEDs is changed. The top cap 3 has an inner thread 311 screwed up with the outer thread 11 on the light transmitting cylinder 1 to firmly secure a lamp 31 inside the light transmitting cylinder 1, which lamp 31 is connected to the battery unit 52 via the circuit board assembly 2, to produce light transmitting through the top cap 3. The handle 4 is comprised of two opposed shells 4 and 4' connected into a cylindrical structure for fastening the light transmitting cylinder 1 by means of high-frequency heat sealing process, having a plurality of blocks 41 raised from the outer wall surface thereof and disposed around a circle. After the circuit board assembly 2 is fastened in the light transmitting cylinder 1 secured to the handle 4, the power switch 24 and the key 27 are respectively exposed out of the handle 4 convenient for control. Once the battery unit 52 is inserted in the handle and connected to the socket 26, the bottom cap 5 is attached to the handle 4 to seal the bottom end. As shown in the drawing, the bottom cap 5 has a plurality of projecting strips transversely projecting inwards from the top edge thereof defining a plurality of notches 51. By inserting the blocks 41 in the notches 51 and then rotating the handle 4 in either direction through a certain angle relative to the bottom cap 5 permitting the blocks 4 to respectively engage with the projecting strips on the bottom cap 5, the bottom cap 5 is firmly secured to the handle 4 at the bottom end.

Figure 8:
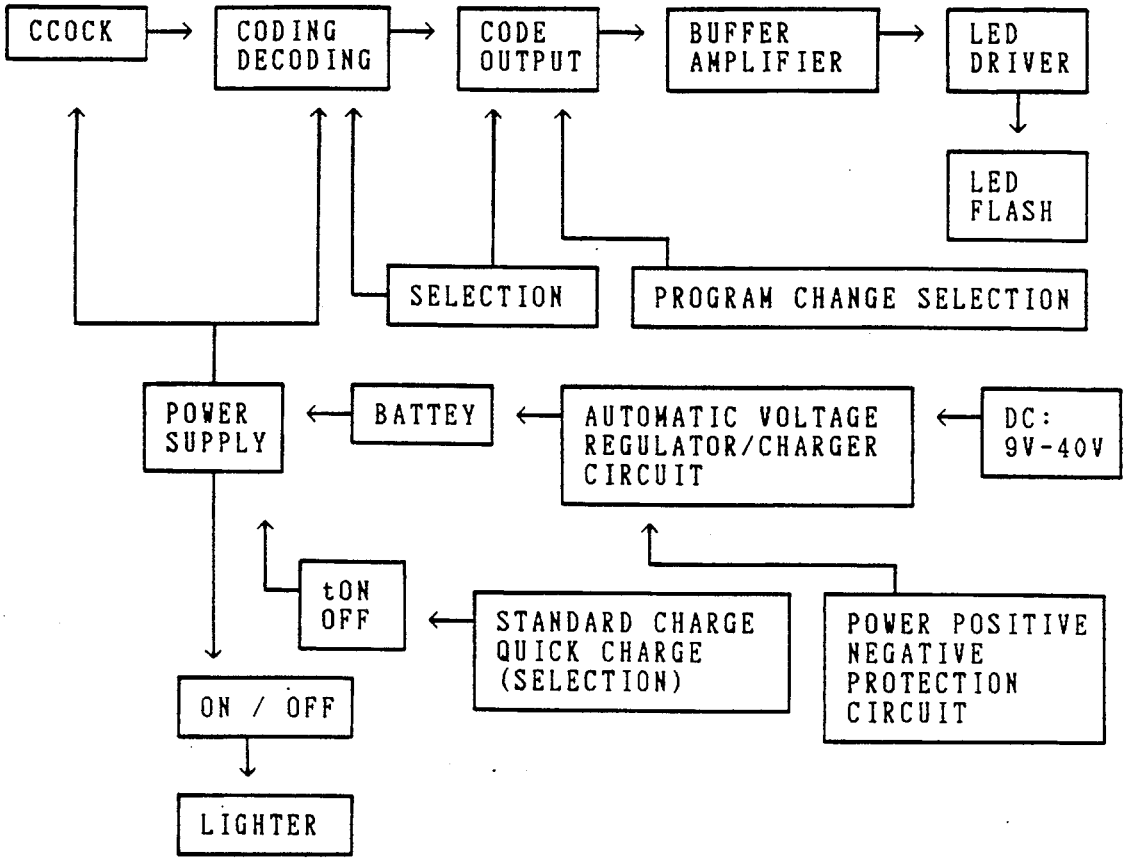
FIG. 8 is a block diagram according to the present invention.

Referring to FIG. 8, a charger circuit 6 may be provided to connect a car battery or AC power supply to the battery unit 52 to electrically charge the battery unit 52.

What is claimed is:

1. For conducting the traffic, a traffic police baton comprising:

a light transmitting cylinder having two opening at two opposite ends and a corrugated surface portion over the inner wall thereof;

a light dispersing film covering over said corrugated surface portion;

a lamp set fastened in said light transmitting cylinder at one end by a rim;

a handle comprised of two opposed shells connected into a cylindrical structure for holding said light transmitting cylinder, having a plurality of blocks raised from the outer wall surface thereof;

a bottom cap attached to said handle at the end opposite to said light transmitting cylinder, having a plurality of projecting strips transversely projecting inwards from the top edge thereof defining therebetween a plurality of notches through which said blocks on said handle are inserted and rotated to respectively engage with said projecting strips;

a circuit board assembly in an elongated shape having one end inserted inside said handle and an opposite end inserted in said light transmitting cylinder, a plurality of holes longitudinally aligned, a plurality of high light intensity of light emitting diodes respectively fastened in said holes at one end and longitudinally disposed in same direction, a plurality of reflectors respectively fastened in said holes at an opposite end to reflect the light from said high light intensity of light emitting diodes to said light dispersing film, a power supply unit fastened in said handle, a power switch for connecting said power supply unit to said lamp set and said high light intensity of light emitting diodes, a selector switch comprised of a spring and a key for controlling the flash mode of said high light intensity of light emitting diodes.

2. The traffic police baton of claim 1, wherein said power supply unit comprises a battery cartridge having two receptacle holes at the top and a plurality of batteries set therein and connected in series with the two opposite polar ends respectively connected to said two receptacle holes, a socket fastened in said circuit board assembly at a lower end, said socket having two spring terminals respectively fastened in said two receptacle holes, and a charger to connect outside AC or DC power supply to charge said batteries.

* * * * *